United States Patent [19]

White, Sr.

[11] 4,392,191

[45] Jul. 5, 1983

[54] CANDLE ASSEMBLY INCLUDING A WINDOWSILL STABILIZER

[75] Inventor: James S. White, Sr., 5931 Westone Rd., Mechanicsville, Va. 23111

[73] Assignees: James Sanford White, Sr.; James Sanford White, Jr., both of Mechanicsville, Va.

[21] Appl. No.: 348,619

[22] Filed: Feb. 12, 1982

[51] Int. Cl.[3] ..... F21P 1/02

[52] U.S. Cl. ..... 362/392; 362/396; 362/810

[58] Field of Search ..... 362/382, 396, 810, 392

[56] References Cited

U.S. PATENT DOCUMENTS

| | | | |
|---|---|---|---|
| D. 226,623 | 4/1973 | Shuford | D7/99 |
| 1,349,566 | 8/1920 | Frisbie . | |
| 1,788,009 | 1/1931 | Brestler . | |
| 1,895,656 | 1/1933 | Gadke | 362/396 |
| 2,063,289 | 12/1936 | Alusas | 47/40 |
| 2,499,731 | 3/1950 | Derington | 362/810 |
| 2,656,454 | 10/1953 | Yacyshyn | 240/52 |
| 3,340,390 | 9/1967 | Imre | 362/396 |
| 3,578,282 | 5/1971 | Olsen | 248/214 |
| 3,596,859 | 8/1971 | MacDonald | 362/396 |

*Primary Examiner*—Stephen J. Lechert, Jr.

*Attorney, Agent, or Firm*—Griffin, Branigan & Butler

[57] ABSTRACT

A candle assembly (10) of a type including an elongated candle (14) mounted on a base (12) also includes a window-sill stabilizer (16) having a thin flat portion for insertion into a space (38) at the interface of the rear edge (40) of a windowsill and the front lower face (42) of a sash-type window (44). In one embodiment, the windowsill stabilizer (46) is integral with the base (48) of the candle assembly and in another embodiment the stabilizer (16) is a separate part from the candle and the base. In the separate embodiment, the stabilizer includes an opening (32) therein through which the candle passes.

8 Claims, 4 Drawing Figures

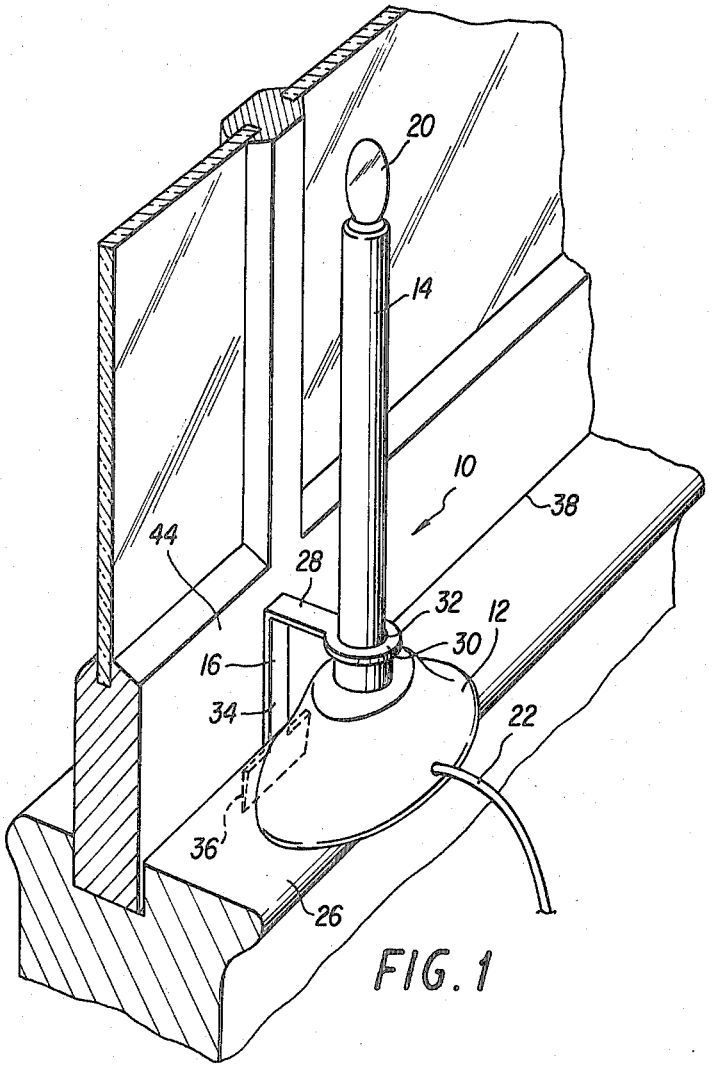
FIG. 1
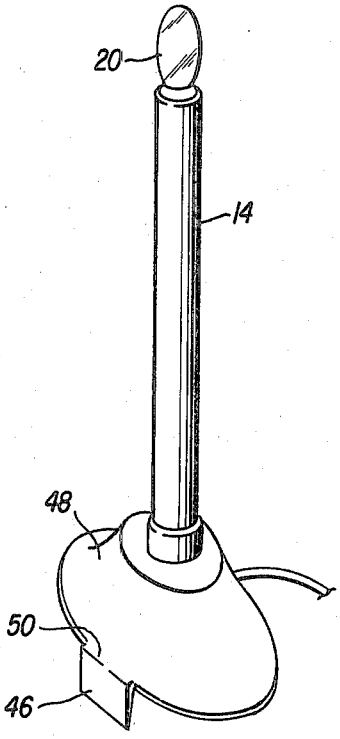
FIG. 4
FIG. 2
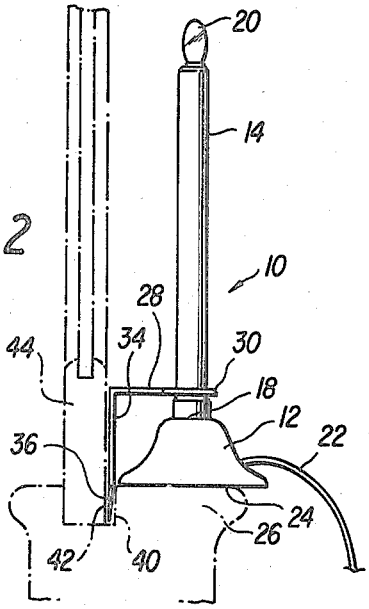
FIG. 3
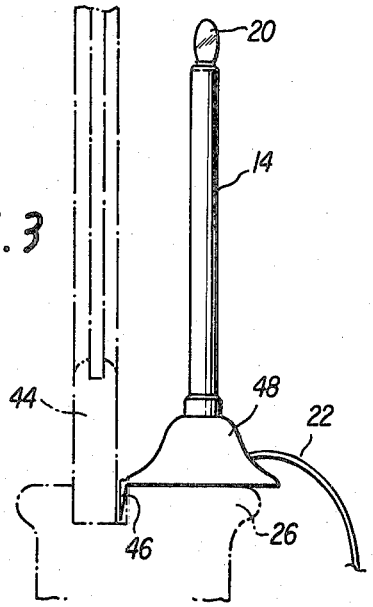

CANDLE ASSEMBLY INCLUDING A WINDOWSILL STABILIZER

BACKGROUND

This invention relates generally to the art of candle supports and in particular is concerned with support of candles placed on interior windowsills.

As used herein the term candle refers to devices resembling wick-type candles which radiate light from the tops thereof in the same manner as a wick-type candles, whether energized by electricity, kerosene, tallow or other means.

For hundreds of years many people have followed the custom of placing candles in windows at Christmas time as well as at other times. A common problem that has been shared by these people is that it is difficult to provide adequate support for the candles on windowsills. This has especially been true in modern years when the candles have been energized by electricity and have had cords attached thereto which have tended to pull them off windowsills onto the floor.

To overcome this "support problem", many people have resorted to taping the bases of candles to windowsills and/or taping the candles themselves to windows. However, this approach has a disadvantage of being unsightly and also leaving adhesive marks on the windows and windowsills.

Others have resorted to placing thumbtacks in window frames and wiring the candles to these thumbtacks, however, again, the wires are unsightly and thumbtacks leave impressions in the window frames.

It is an object of this invention to provide a device for stabilizing support for candles placed upon interior windowsills which is inexpensive to manufacture, pleasing to look at, nondestructive and uncomplicated to use, and efficient in operation.

SUMMARY

According to principles of this invention, a candle-assembly stabilizer is engaged with a candle/base composite and includes a thin flat portion for insertion into a space at the interface of the rear edge of a windowsill and the lower front face of a sash-type window frame. The candle-assembly stabilizer remains force fitted in this space to thereby stabilize support for the engaged candle/base composite. In one embodiment, the stabilizer is integral with a base of a candle assembly. In another embodiment, the stabilizer is a separate member. In a preferred embodiment of the separate-member embodiment, the stabilizer has a hole therethrough for receiving candles for stabilizing their respective assemblies.

BRIEF DESCRIPTION OF THE DRAWINGS

The foregoing and other objects, features and advantages of the invention will be apparent from the following more particular description of the preferred embodiment of the invention, as illustrated in the accompanying drawings in which like reference characters refer to the same parts throughout the different views. The drawings are not necessarily to scale, emphasis instead being placed upon illustrating principles of the invention.

FIG. 1 is an isometric view of a candle assembly of this invention resting on a windowsill;

FIG. 2 is a side view of the candle assembly and window of FIG. 1;

FIG. 3 is a side view similar to FIG. 2 of another embodiment of the invention; and FIG. 4 is an isometric view of the candle assembly of FIG. 3 when seen from the rear.

DESCRIPTION OF THE PREFERRED EMBODIMENT

Referring to FIG. 1, a candle-assembly 10 includes a base 12, a candle 14, and a candle-assembly stabilizer 16. The candle 14 is fixedly attached to the base 12 at its lower end 18 and has a light source 20 at its upper end. In the embodiment depicted in FIGS. 1 and 2 the light source 20 is an electric bulb which is energized via an electric cord 22, although the light source could be a flame. The base 12 has a bottom surface 24 for resting on a flat surface, such as the top of an interior windowsill 26.

The candle-assembly stabilizer, in a preferred embodiment, is made of transparent hard plastic and, when viewed from the side, as in FIG. 2, has an L-shape. Although the L-shape depicted in the drawings has a 90° angle, this angle could be more curved. An upper leg 28 of the windowsill stabilizer 16 has an enlarged portion 30 with a hole 32 therethrough for receiving the candle 14. A lower leg 34 of the candle-assembly stabilizer 16 includes at its lower end a thin, flat, portion 36 which is dimensioned to be inserted into a space 38 at the interface of the rear edge 40 of the windowsill 26 and the lower front face 42 of a sash-type window frame 44. The thin, flat, portion 36 is wedge shaped in section, as can been seen in FIG. 2, with the blade of the wedge being directed downwardly so that the thin flat portion 36 can more easily be wedged between the window frame 44 and the rear edge 40 of the sill 26.

It should be noted that the candle-assembly stabilizer 16 is a separate integral member from the base 12 and the candle 14, however, it engages the candle 14 by having the candle 14 extend through the hole 32 in the enlarged portion 30 of the candle-assembly stabilizer 16.

In operation, the candle assembly 10 is assembled by inserting the candle 14 through the hole 32 in the candle-assembly stabilizer 16. The bottom surface 24 of the base 12 is then placed on the interior windowsill 26 and, with the window sash 44 closed, the thin, flat, portion 36 of the candle-assembly stabilizer 16 is pressed down into the space 38 between the window 44 and the back 40 of the sill 26. Although the candle assembly can be easily removed by simply pulling the thin, flat, portion 36 of the stabilizer 16 upwardly from the space 38, the candle-assembly 10 is held firmly in position against falling laterally off the windowsill 26 when the assembly is properly mounted thereon. It can be seen in FIG. 1 that the thin, flat, portion 36 is enlarged laterally which provides lateral stability to the candle-assembly 10 (longitudinally along the windowsill 26) as well as in a direction away from the window 44.

In the embodiments of FIGS. 3 and 4, a plastic candle-assembly stabilizer 46 is integral with a plastic candle base 48. In this embodiment, the candle-assembly stabilizer 46 is a wedged shape, downwardly-protruding member which joins the base 48 at its upper end 50. The operation of the candle-assembly stabilizer 46 is somewhat the same as the stabilizer 16 in that it is inserted between a window frame and the rear end of a windowsill 26 when the window is closed as is depicted in FIG. 3. Again, the candle assembly of FIGS. 3 and 4 can be easily removed from a windowsill 26 by lifting it upwardly, however, it is stabilized from falling fowardly off the windowsill 26, and from falling over sideways along the windowsills 26, by the candle-assembly stabilizer 46 being embedded between the windowsill 26 and the window frame 44.

The candle assembly of this invention not only allows a candle assembly to easily be installed on, and removed from, a windowsill, without necessitating the opening of a window, but also has a pleasing, non-obtrusive, appearance. Further, candle assemblies of this invention are easy and economical to manufacture and are quite effective in operation.

While the invention has been particularly shown and described with reference to a preferred embodiment, it will be understood by those skilled in the art that various changes in form and detail may be made therein without departing from the spirit and scope of the invention.

I claim:

1. A candle assembly comprising:

an elongated candle to be normally held at a lower and thereof in a generally vertical orientation and having a light-source means mounted at an upper end thereof for giving off light;

a base member attached to the lower end of the candle to form a candle/base composite, said base member having a bottom surface for resting on a generally flat surface and thereby supporting said candle in said generally vertical orientation;

a candle-assembly stabilizer engaging said candle/-base composite, said candle-assembly stabilizer including a thin flat means positioned below said basemember bottom surface for insertion into a space at an interface of a rear edge of a windowsill and a lower front face of a sash-type window frame, said thin, flat, portion providing a force fit in said space to thereby stabilize support for said candle assembly when said bottom surface of said base is resting on said windowsill.

2. A candle assembly as in claim 1 wherein said candle-assembly stabilizer is integral with said base.

3. A candle assembly as in claim 1 wherein said stabilizer is a separate member from said candle and said base but can be brought into selective engagement therewith.

4. A candle assembly as in claim 3 wherein said stabilizer engages said candle.

5. A candle assembly as in claim 4 wherein said stabilizer has a hole therein through which said candle extends.

6. A candle-assembly stabilizer for engaging a candle/base composite, comprising an elongated candle held in a base, and stabilizing the position of said candle/base composite when the base supports said candle in a vertical position on a windowsill, said candle-assembly stabilizer comprising:

an engaging portion for engaging said candle/base composite, said candle-assembly stabilizer including a thin, flat means positioned below a bottom surface of said base member when said stabilizer is engaging said candle/base composite for insertion into a space at the interface of a rear edge of a windowsill and a lower front face at a sash-type window frame, said thin, flat means providing a force fit in said space to thereby stabilize support for said engaged candle and base when said bottom surface of said base is resting on said windowsill.

7. A candle-assembly stabilizer as in claim 6 wherein said stabilizer engages said candle.

8. A candle-assembly stabilizer as in claim 7 wherein said candle-assembly stabilizer has a hole therein through which said candle extends when said stabilizer is inserted into said space.

* * * * *

UNITED STATES PATENT AND TRADEMARK OFFICE

CERTIFICATE OF CORRECTION

PATENT NO. : 4,392,191

DATED : July 5, 1983

INVENTOR(S) : James S. White, Sr.

It is certified that error appears in the above—identified patent and that said Letters Patent is hereby corrected as shown below:

Column 1, line 51, after "preferred", delete "embodiment" and insert -- arrangement -- in lieu thereof.
Column 3, line 23, change "and" (first occurrence) to -- end--.
Column 3, line 34, insert a hyphen between "base" and "member".
Column 4, line 27, delete "at" and insert -- of -- in lieu thereof.

Signed and Sealed this

*Thirteenth* Day of *September 1983*

[SEAL]

*Attest:*

GERALD J. MOSSINGHOFF

*Attesting Officer*

*Commissioner of Patents and Trademarks*